US008333403B2

(12) United States Patent
Popel

(10) Patent No.: US 8,333,403 B2
(45) Date of Patent: Dec. 18, 2012

(54) SKI WITH A CLIMBING SYSTEM, PARTICULARLY A CROSS-COUNTRY (XC) SKI

(76) Inventor: Jiri Popel, Usti nad Orlici (CZ)

( * ) Notice: Subject to any disclaimer, the term of this patent is extended or adjusted under 35 U.S.C. 154(b) by 0 days.

(21) Appl. No.: 13/131,678

(22) PCT Filed: Dec. 7, 2009

(86) PCT No.: PCT/CZ2009/000147

§ 371 (c)(1),
(2), (4) Date: Jul. 28, 2011

(87) PCT Pub. No.: WO2010/063246

PCT Pub. Date: Jun. 10, 2010

(65) Prior Publication Data

US 2011/0278824 A1 Nov. 17, 2011

(30) Foreign Application Priority Data

Dec. 5, 2008 (CZ) ..... PV 2008-774

(51) Int. Cl.
*A63C 5/02* (2006.01)

(52) U.S. Cl. ..... 280/604

(58) Field of Classification Search ..... 280/604, 280/601, 603, 605, 607, 608, 11.14, 11.15, 280/826, 12.1, 12.11, 12.12, 14.21, 14.25, 280/28.11, DIG. 13
See application file for complete search history.

(56) References Cited

U.S. PATENT DOCUMENTS 2,122,718 A * 7/1938 Hikel ..... 280/605
4,121,854 A * 10/1978 Cornu ..... 280/612
4,239,255 A * 12/1980 Boudreau et al. ..... 280/605
4,262,924 A * 4/1981 Corwin ..... 280/603
4,596,400 A * 6/1986 Stenius ..... 280/605
4,674,764 A * 6/1987 Miesen ..... 280/604
4,690,423 A * 9/1987 DeVigili ..... 280/605
4,718,694 A * 1/1988 Brice et al. ..... 280/605
4,780,929 A * 11/1988 Burns et al. ..... 16/349
5,002,302 A * 3/1991 Quaggiotti ..... 280/603
5,037,124 A * 8/1991 Quaggiotti ..... 280/603
5,577,754 A * 11/1996 Hwu ..... 280/605
5,649,722 A * 7/1997 Champlin ..... 280/818
5,735,063 A * 4/1998 McManus ..... 36/124
5,816,602 A * 10/1998 Hayashi ..... 280/604
6,367,173 B2 * 4/2002 Lancon ..... 36/122
7,080,850 B2 * 7/2006 Ekberg ..... 280/603
7,150,464 B2 * 12/2006 Ekberg ..... 280/603
7,159,875 B2 * 1/2007 Seymour ..... 280/14.21

(Continued)

FOREIGN PATENT DOCUMENTS

DE 2732091 A1 2/1979

(Continued)

OTHER PUBLICATIONS

International Search Report: mailed Aug. 7, 2010; Appln. PCT/DZ2009/000147.

*Primary Examiner* — Katy M Ebner
*Assistant Examiner* — Brodie Follman
(74) *Attorney, Agent, or Firm* — Ladas & Parry LLP

(57) ABSTRACT

The ski with a climbing system, particularly a cross-country ski consists of a front gliding part (1) and a rear gliding part (2) with an integrated kick zone (3).

12 Claims, 5 Drawing Sheets

U.S. PATENT DOCUMENTS

| | | | | |
|---|---|---|---|---|
| 7,681,904 | B2 * | 3/2010 | Ekberg | 280/603 |
| 7,938,432 | B2 * | 5/2011 | Schlegel et al. | 280/601 |
| 2001/0010130 | A1 * | 8/2001 | Lancon | 36/122 |
| 2006/0138747 | A1 * | 6/2006 | Hartmann | 280/604 |
| 2007/0126190 | A1 * | 6/2007 | Fritschi | 280/11.26 |
| 2008/0174089 | A1 * | 7/2008 | Ekberg | 280/603 |
| 2009/0189370 | A1 * | 7/2009 | Krafft et al. | 280/601 |
| 2010/0001491 | A1 * | 1/2010 | Schlegel et al. | 280/604 |
| 2010/0219614 | A1 * | 9/2010 | Ekberg | 280/624 |
| 2010/0289251 | A1 * | 11/2010 | Korpua | 280/615 |
| 2011/0278824 | A1 * | 11/2011 | Popel | 280/604 |
| 2011/0291386 | A1 * | 12/2011 | Marechal et al. | 280/607 |
| 2012/0018981 | A1 * | 1/2012 | Lengel | 280/623 |

FOREIGN PATENT DOCUMENTS

| | | | |
|---|---|---|---|
| DE | 3617967 | A1 | 12/1987 |
| EP | 0193080 | A2 | 9/1986 |
| JP | 52-058632 | A | 5/1977 |

* cited by examiner

SKI WITH A CLIMBING SYSTEM, PARTICULARLY A CROSS-COUNTRY (XC) SKI

THE FIELD OF THE INVENTION

The invention deals with a ski with a mechanical climbing system preventing it from back gliding at the moment of the kick, while maintaining high gliding performance!

BACKGROUND AND SUMMARY OF THE INVENTION

Mechanic systems, however not used in cross-country skis in practice, are known from patent documentation, e.g. pat. DE 3617967 with movable kick zone, also classic skies using ski wax as the gripping agent are not able to avoid back gliding of the ski at the moment of the kick and provide high gliding performance at the same time.

The design of the ski, forming one unit is the main cause of these drawbacks, the ski being unable to perform sufficient pressure of the kick zone with the high friction coefficient necessary for compacting a snow formation of specific length and width under the kick zone and thus create the conditions resulting from physical laws and enabling efficient movement on the snow cover due to its length with limited elasticity and substantially varied snow coherence.

The aim of the invention is complete separation of the gliding function from the kicking function, their mutual independence enabling optimizing of each according to physical laws for friction without compromises necessary at the existing state of technology.

The aim of the invention is achieved by a ski with a climbing system, particularly a cross-country ski, the principle of which is based on the fact that it consists of a front gliding part and a rear gliding part with an integrated kick zone, where the front gliding part is connected with the rear gliding part by a bridge enabling mutual movement between the gliding position and the kick position, while the front gliding part tilts against the rear gliding part in an angle changing according to the mutual position of the gliding parts, and a rod, located between a three-position snap-bolt and a lock, is connected to the bridge. Additional and interchangeable gripping agents may be advantageously attached to the kick zone. A device for permanent locking of the gliding position may be advantageously located on the bridge.

In another advantageous embodiment weight and position sensors are located at the boot heel guide area, connected via a control unit with a servo drive locking the bridge. The servo drive may also be controlled by a remote controller for the permanent locking of the glide position.

The principle of the invention is based on division of the ski into two parts and their connection with the bridge enabling "breaking" of the ski at the kick moment with sufficient lifting in proper angle, so that the kick zone of the ski, which bears the whole weight of the skier at the moment, can compact such a snow formation situated under the ski, which is able to absorb the kick energy without being destructed and at the same time the kick zone, the size, shape and surface of which may be changed according to the current snow quality, is pressed into the snow.

All the conditions defined by physical laws are thus met: high friction coefficient of the adhesive surface, sufficient pressure and compaction of the snow formation of suitable size and shape under the grip zone of the ski. In the bridge position suitable for gliding the adhesive surface is completely out of touch with the snow so there are ideal gliding conditions. This meets the basic condition for remarkable improvement of the usable qualities of a cross-country ski—perfect gliding and efficient kick.

BRIEF DESCRIPTION OF THE DRAWINGS

The invention will be shown in detail in the drawings representing the preferred embodiment, where.

EXAMPLES OF THE INVENTION EMBODIMENTS

It shall be understood that the specific examples of realization of the invention described and illustrated hereinbelow are presented for illustration and not as a limitation of examples of design of the invention to the provided examples. The experts familiar with the state of the art will find or will be able to identify a higher or smaller amount of equivalents during the application of routine experimenting for specific realizations of the invention, which are described herein specially. Such equivalents shall also be included into the range of the claims.

Figure 4:
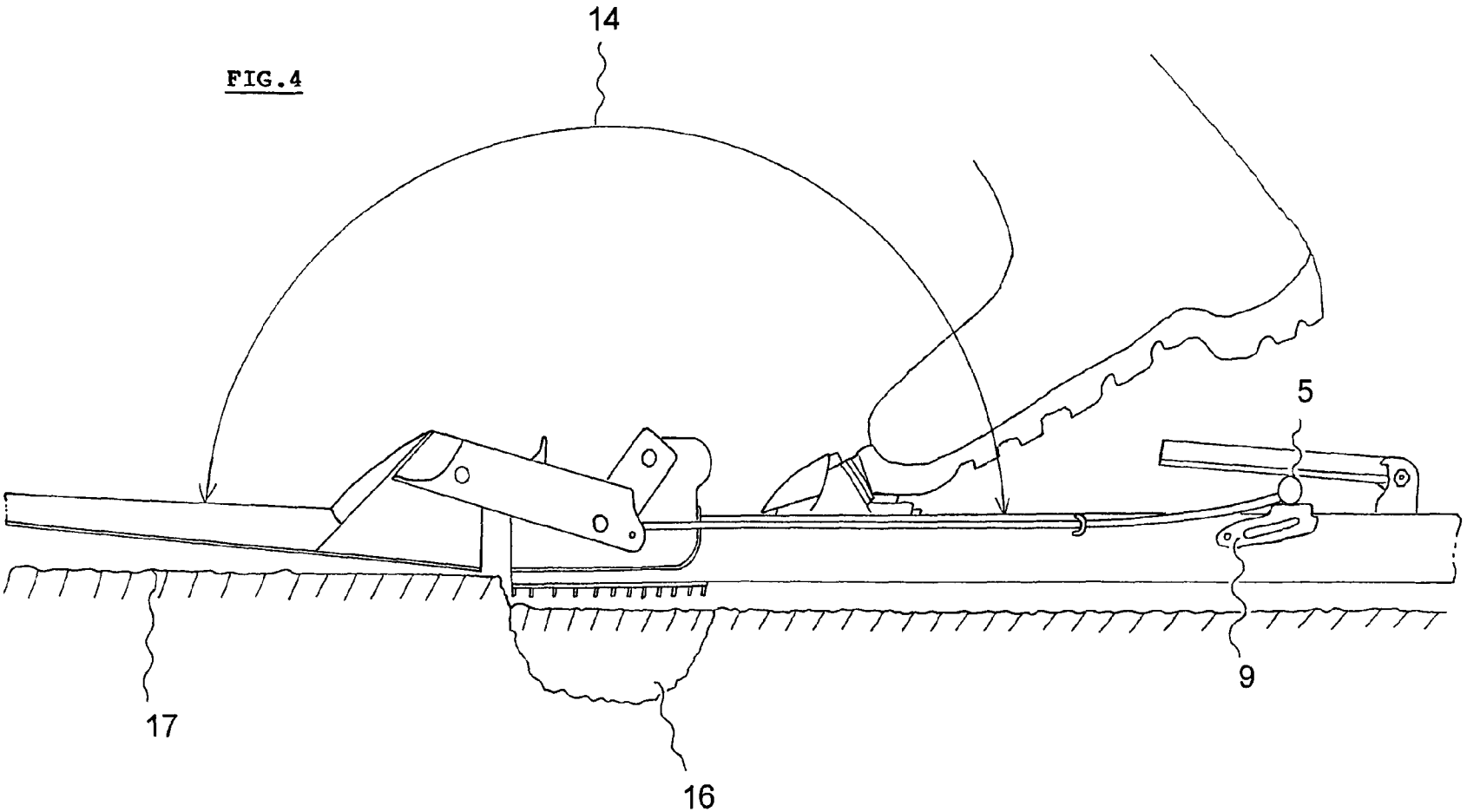
FIG. 4 shows the ski in the kick position and FIG. 5 shows a scheme of the electronic locking of the bridge.
Figure 5:
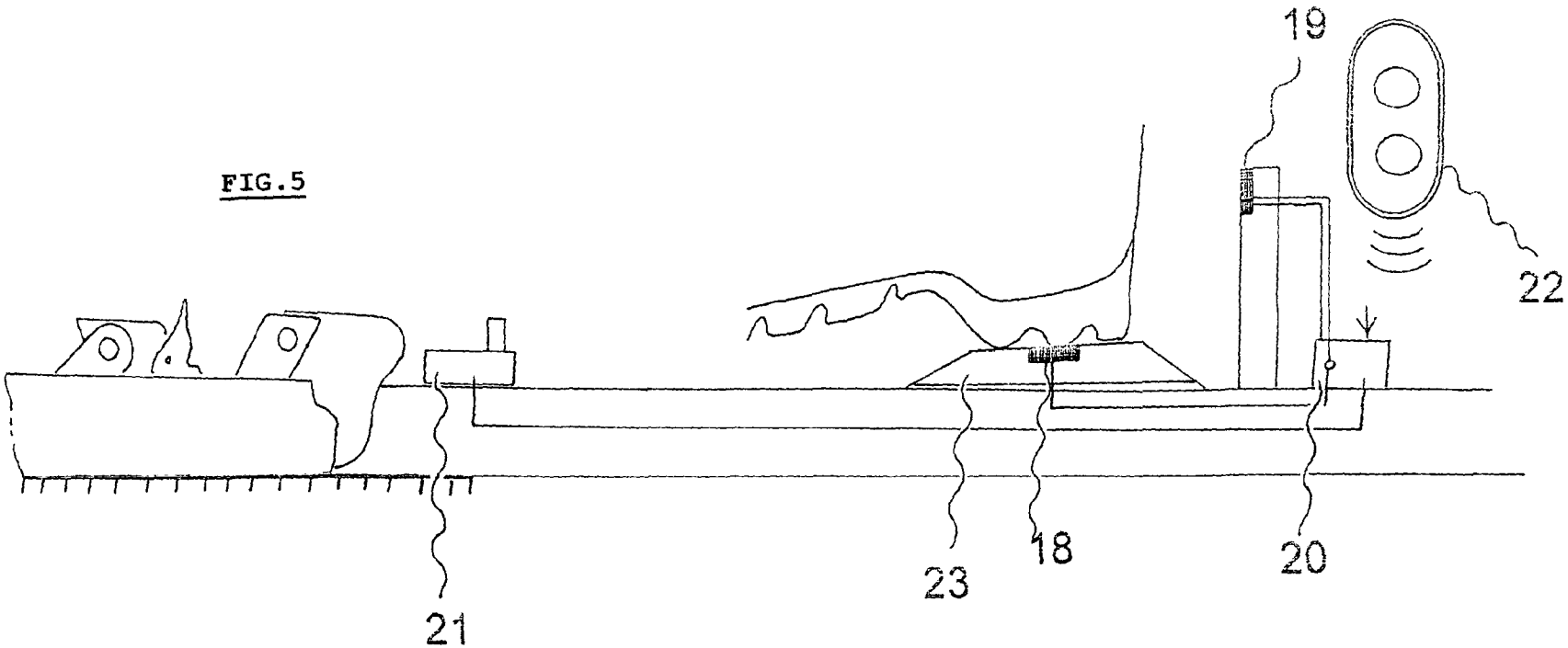

The ski with the climbing system will be described as an XC ski. Each of the pair of skis consists of a front gliding part 1, a rear gliding part 2 with an integrated kick zone 3. The front gliding part 1 is connected to the rear gliding part 2 with a bridge 4, involving a pair of tilting two-arm levers 6, 7, attached by their upper ends tiltingly in a holder 10, which is a part of the rear gliding part 2. The holder 10 is equipped with a return spring 11 suspended by its other end on the rear lever 7. A double rod 5 leads from the bridge 4 between the lock 8 tiltingly suspended in a hinge 12 and a three-position snap-bolt 9. Interchangeable grip agents 13 are attachable to the kick zone 3. The holder 10 is also equipped with a two-position locking device 15. In the kick position FIG. 4 the front gliding part 1 forms with the rear gliding part 2 angle 14. A snow formation 16 is created by the kick zone 3 in the snow cover 17.

A weight sensor 18 and a position sensor 19 are mounted at the heel guide area 23 and connected to the control unit 20 controlling a servo drive 21, located on the holder 10. The system also includes a remote controller 22 of the servo drive 21.

Figure 1:
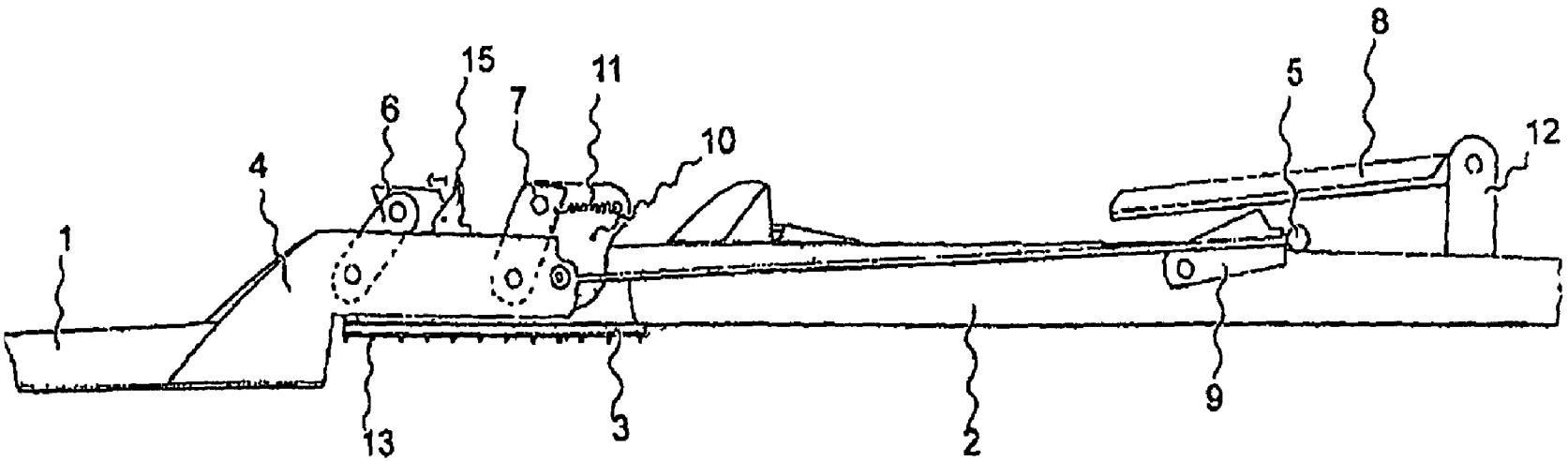
FIG. 1 shows a side view of the ski in the rest position.
Figure 2:
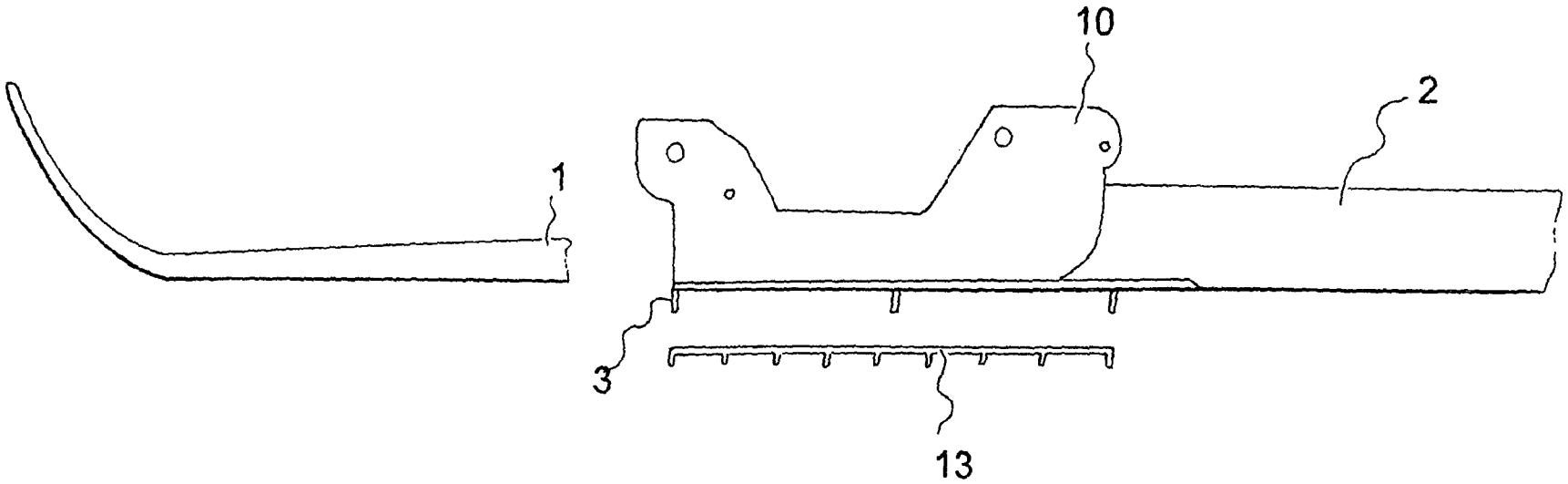
FIG. 2 shows division of the ski to the main parts.
Figure 3:
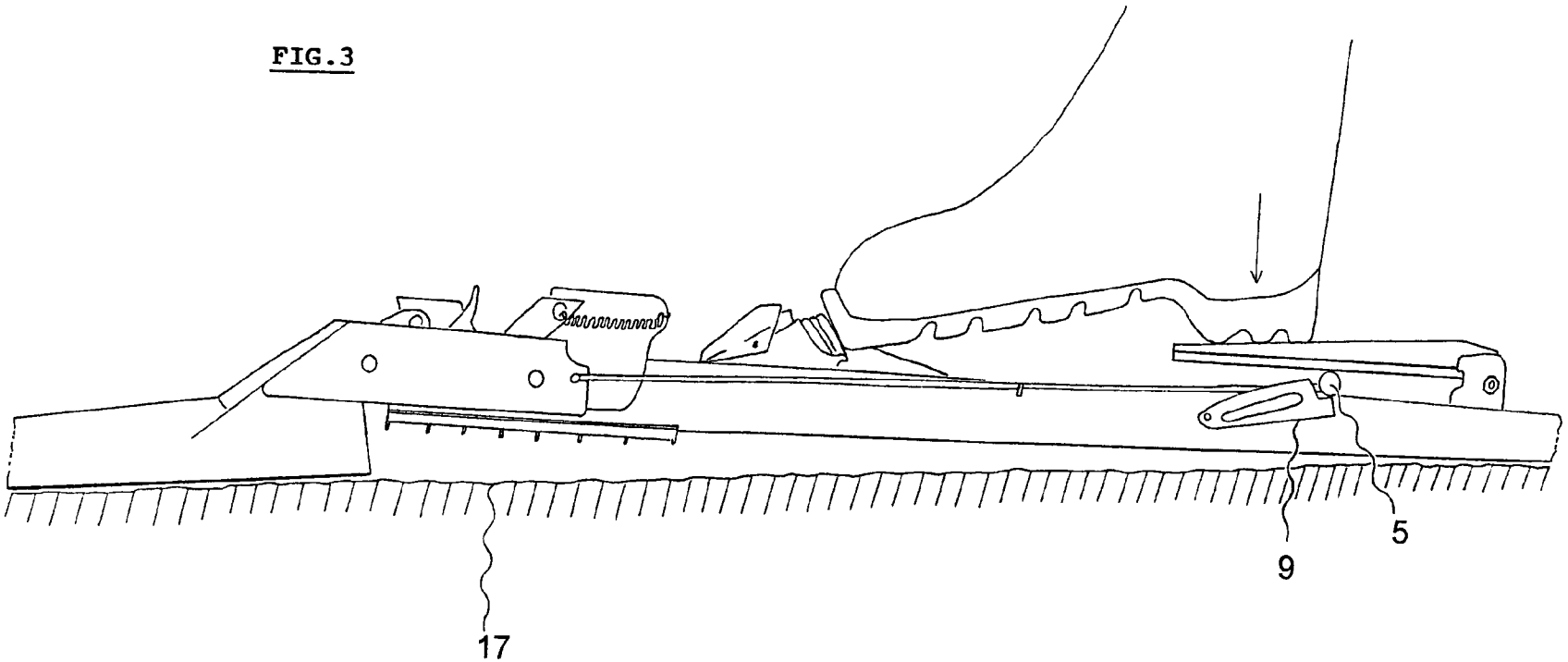
FIG. 3 shows the ski in the gliding position.

The operation of the ski according to the preferred embodiment is as follows:

At the basic gliding position, FIG. 3, the pressure of the skier's weight is concentrated via the boot heel on the lock 8, the grip zone is out of touch with the snow and the ski glides ahead. Movement of the body weight centre ahead reduces the heel pressure on the lock 8, the rod 5 of the bridge 4 is torn by the body weight along the inclined surface of the snap-bolt 9 out of the lock 8 to the upper surface of the snap-bolt 9 and the weight body pressure still acting tilts the ski to the kick position 4. Still acting weight body pressure together with the kick energy of the skier's foot presses the kick zone 3 provided with gripping agents 13 to the snow cover 17. Thanks to the sufficient stroke of the bridge 4 the compression of the snow under the kick zone 3 continues, until a compacted snow formation 16 is achieved, the parameters of which enable transfer of the kick energy without its destruction to the snow cover and this phase ends with the kick. The ski is unloaded after the kick and the return spring 11 returns the ski back to the gliding position, FIG. 3, the rod 5, of the bridge 4 locks behind the first stage of the snap-bolt 9, which causes pre-locking of the lock 8. This prevents the ski from accidental return to the kick position during its movement ahead, loading and gliding. By repeated loading of the ski the boot heel loads the lock 8, again and it presses the three-position snap bolt 9. Its compression enables movement of the rod 5 to the second stage of the three-position snap-bolt 9. Continued pressure of the boot causes clenching of the rod 5 between the lock 8 and the snap-bolt 9. At that moment the ski is prepared for gliding, which completes the whole cycle, which is still repeated in the right and the left skis.

In a situation when the skier expects a long or dangerous downhill run the ski may be locked in the gliding position for the required time by pressing the upper end of the locking device 15. After returning the locking device 15 to the original position the ski is prepared for the normal cycle again.

The mechanical locking system may be advantageously substituted by an electronic one. A weight sensor 18 and a position sensor 19 are located at the boot heel guide area 23 and connected via the control unit 20 to a servo drive 21 locking the bridge 4. The servo drive 21 is also controlled by a remote controller 22.

The control unit 20 permanently evaluates the pressure and position of the boot heel; it locks and releases the bridge 4 by the servo drive 21 according to the current state. The ski may be locked in the sliding position for required time by the remote controller 22.

The invention claimed is:

1. A ski with a climbing system consisting of a front gliding part and a rear guiding part, comprising:

a front gliding part; and a rear gliding part with an integrated kick zone, where the front gliding part is connected to the rear gliding part with a bridge, enabling mutual movement between a gliding position and a kick position, while the front gliding part tilts against the rear gliding part within an angle changable according to the mutual position of the gliding parts, a rod, located between a three-position snap-bolt and a lock, the rod being connected to the bridge.

2. A ski with a climbing system according to claim 1, further comprising additional and interchangeable gripping agents attached to the kick zone.

3. A ski with a climbing system according to claim 1, further comprising a device located on the bridge for locking of the movement of at least one of the front or rear gliding parts on the bridge.

4. A ski with a climbing system according to claim 1, further comprising a weight sensor and a position sensor located on the ski at a boot heel guide and connected via a control unit to a servo drive locking the bridge.

5. A ski with a climbing system according to claim 4, wherein the servo drive is also controlled by a remote controller for locking of the gliding position.

6. A ski with a climbing system according to claim 2, further comprising a device located on the bridge for locking of the movement of at least one of the front or rear gliding parts on the bridge.

7. A ski with a climbing system according to claim 2, further comprising a weight sensor and a position sensor located on the ski at a boot heel guide and connected via a control unit to a servo drive locking the bridge.

8. A ski with a climbing system according to claim 3, further comprising a weight sensor and a position sensor located on the ski at a boot heel guide and connected via a control unit to a servo drive locking the bridge.

9. A ski with a climbing system according to claim 6, further comprising a weight sensor and a position sensor located on the ski at a boot heel guide and connected via a control unit to a servo drive locking the bridge.

10. A ski with a climbing system according to claim 7, wherein the servo drive is also controlled by a remote controller for locking of the gliding position.

11. A ski with a climbing system according to claim 8, wherein the servo drive is also controlled by a remote controller for locking of the gliding position.

12. A ski with a climbing system according to claim 9, wherein the servo drive is also controlled by a remote controller for locking of the gliding position.

* * * * *